United States Patent [19]

DiMatteo et al.

[11] 4,014,355

[45] Mar. 29, 1977

[54] BIDET AND HYGIENIC CLEANSING ARRANGEMENT

[75] Inventors: Paul L. DiMatteo, Huntington; Henry V. Diaferia, Brentwood; Robert M. Segnini, Stonybrook, all of N.Y.

[73] Assignee: Dynell Electronics Corporation, Melville, N.Y.

[22] Filed: Aug. 11, 1975

[21] Appl. No.: 603,743

[52] U.S. Cl. ..... 134/30; 4/7; 134/34; 134/95; 134/107; 134/180; 134/181

[51] Int. Cl.[2] ..... A47K 10/48; A61H 33/00; B08B 3/02; B08B 3/10

[58] Field of Search ..... 134/30, 34, 37, 24, 134/95, 107, 167 R, 171, 180, 181; 4/7, 6; 239/549; 128/251

[56] References Cited

UNITED STATES PATENTS

| | | | |
|---|---|---|---|
| 2,344,561 | 3/1944 | Popil | 4/7 |
| 2,605,477 | 8/1952 | Monserrat | 4/7 |
| 2,668,083 | 2/1954 | Kirchner | 239/549 X |
| 2,949,109 | 8/1960 | Koolnis | 239/549 X |
| 3,208,145 | 9/1965 | Turner | 239/549 X |
| 3,605,124 | 9/1971 | Marcard et al. | 4/7 |
| 3,606,895 | 9/1971 | Brown | 134/181 X |
| 3,845,509 | 11/1974 | Lieber | 4/7 |

*Primary Examiner*—S. Leon Bashore
*Assistant Examiner*—Richard V. Fisher
*Attorney, Agent, or Firm*—Max Fogiel

[57] ABSTRACT

An arrangement mountable on the rim of a bidet receptacle or a toilet for providing bidet applications and hygienic cleansing in conjunction with the use of the toilet. Brackets are fastened to the rim of the toilet and carry a pivoted arm on which are mounted a water spray head and a dry air head. These heads are moved over selected areas of the opening of the receptacle or toilet. The arm may be rotated, tilted, and slid to cover the area of the receptacle opening. The arm may also be manipulated manually or by mechanical means in accordance with the cleansing requirements of the user.

17 Claims, 31 Drawing Figures

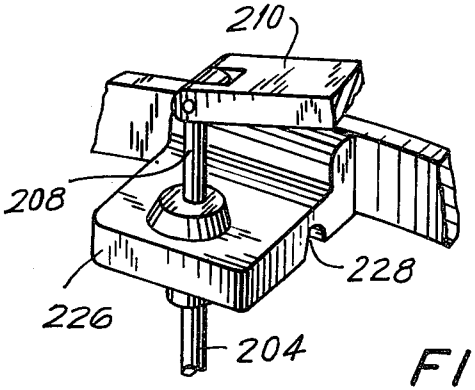
FIG. 23
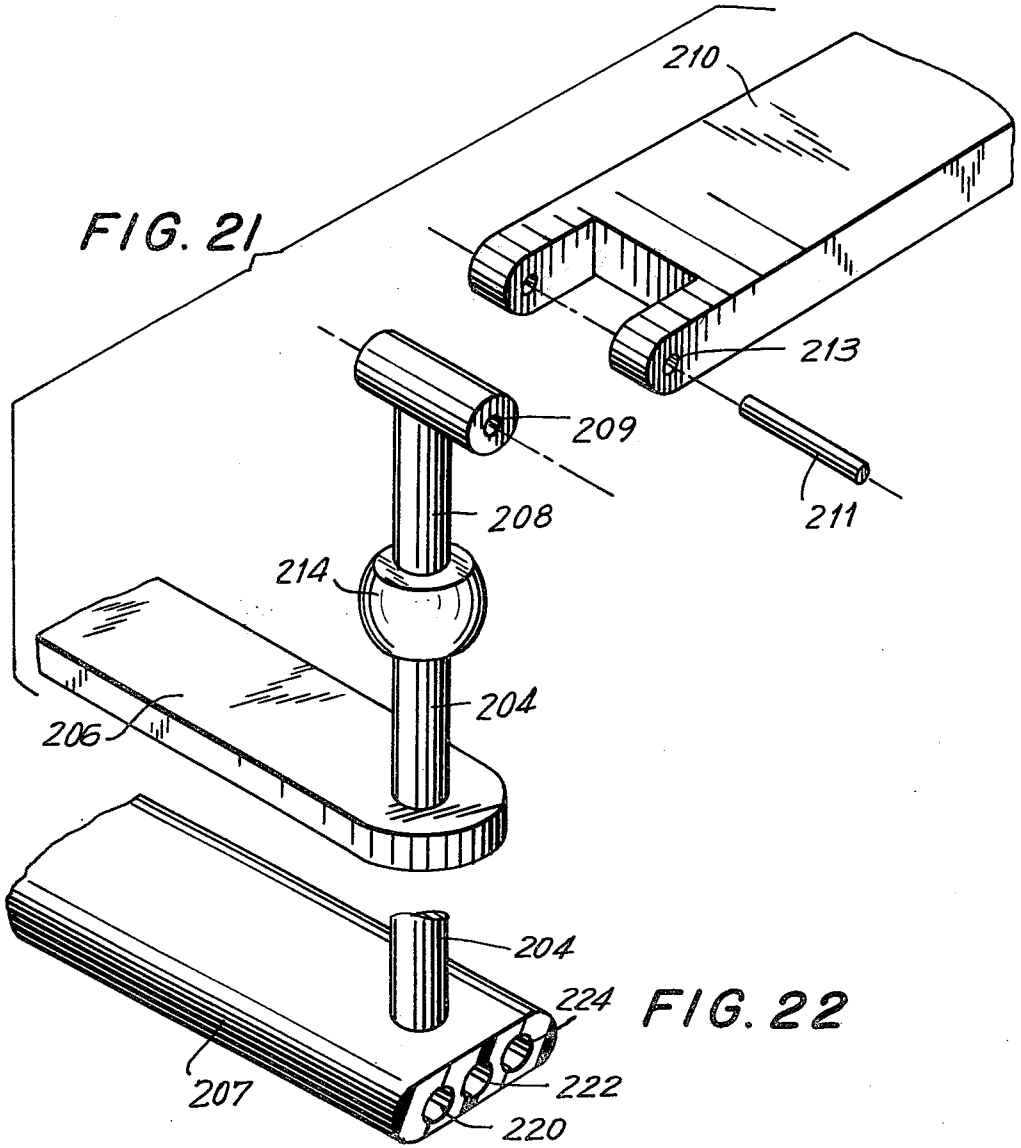
FIG. 21
FIG. 22

BIDET AND HYGIENIC CLEANSING ARRANGEMENT

BACKGROUND OF THE INVENTION

In the use of toilets by persons that are invalids or have injuries, it is often desirable to provide for means by which the user of a toilet may benefit from a cleansing operation without have to resort to conventional methods involving toilet paper, for example, Such cleansing means is particularly applicable to persons that have been paralyzed, for example, are weak, or are otherwise incapable of performing personally the cleansing procedure in the conventional manner.

Apparatus intended for such cleansing applications, is already known in the art. Such known apparatus, however, lacks the feature of providing effective cleansing over varying locations of the user's posterior, for example. There is no provision in the conventional apparatus for providing a movable water spray over different areas of the user's posterior in order to achieve a complete and effective cleansing procedure as may be required.

Furthermore, the devices, heretofore, do not also provide for means by which a drying air stream may be applied to the wetted areas of moving the air stream over the required areas of the user's posterior.

The conventional apparatus, moreover, requires the exercise of special skill for installation, and is subject to being soiled during use of the toilet.

Accordingly, it is an object of the present invention to provide an arrangement for use in conjunction with a toilet to provide hygienic cleansing procedures by applying a movable water spray followed by a movable drying air stream.

Another object of the present invention is to provide an arrangement of the foregoing character which may be mounted on the rim of a toilet bowl without requiring the exercise of special skills.

A further object of the present invention is to provide apparatus for applying cleansing procedures in conjunction with a toilet, which is particularly simple in design and may be economically fabricated.

A still further object of the present invention is to provide an arrangement, as described, which may be operated manually or by mechanical means.

A still further object of the present invention is to provide cleansing apparatus for use in conjunction with a toilet, which may be retained free from becoming soiled as a result of usage of the toilet.

It is also an object of the present invention to provide hygienic cleansing apparatus, as described, which may be mounted on a basin type of structure for providing bidet applications.

SUMMARY OF THE INVENTION

The objects of the present invention are achieved by providing two brackets which may be fastened to the rim of the toilet bowl by means of screws, for example. Fastened to these brackets, is a plate-shaped member having a longitudinal slot for supporting one end of a lever. This lever is pivoted on one of the brackets by means of a pin passing through a longitudinal slot in the lever. The pin is held by the bracket which serves as the pivot support for the lever. The combination of the slot in the lever and in the plate-shaped member, allows the lever to have freedom of motion at its ends, so as to cover a substantial area within the interior of the toilet bowl.

In accordance with the present invention, one end of the lever projects into the interior of the toilet bowl, and carries a head for applying a spray of cleansing water or other fluid. Adjacent to the head for applying the cleansing fluid, is a head for applying a stream of drying air. The other end of the lever projects to the exterior of the toilet bowl where it may be manipulated either by hand or mechanical means, to apply motion to the other end of the lever carrying the heads for cleansing fluid and drying air. Cleansing water and drying air are supplied to the heads by means of flexible tubing.

The novel features which are considered as characteristic of the invention are set forth in particular in the appended claims. The invention itself, however, both as to its construction and its method of operation, together with additional objects and advantages thereof, will be best understood from the following decription of specific embodiments when read in connection with the accommpanying drawings.

BRIEF DESCRIPTION OF THE DRAWING

FIG. 21 is an exploded perspective view and shows a linkage connection used in the embodiment of FIG. 19;

FIG. 22 is a perspective view and shows the construction of a supporting arm used to carry the outlet heads for water and air;

FIG. 23 is a partial perspective view and shows the construction of another embodiment in the linkage of FIG. 19;

DESCRIPTION OF THE PREFERRED EMBODIMENTS

Figure 1:
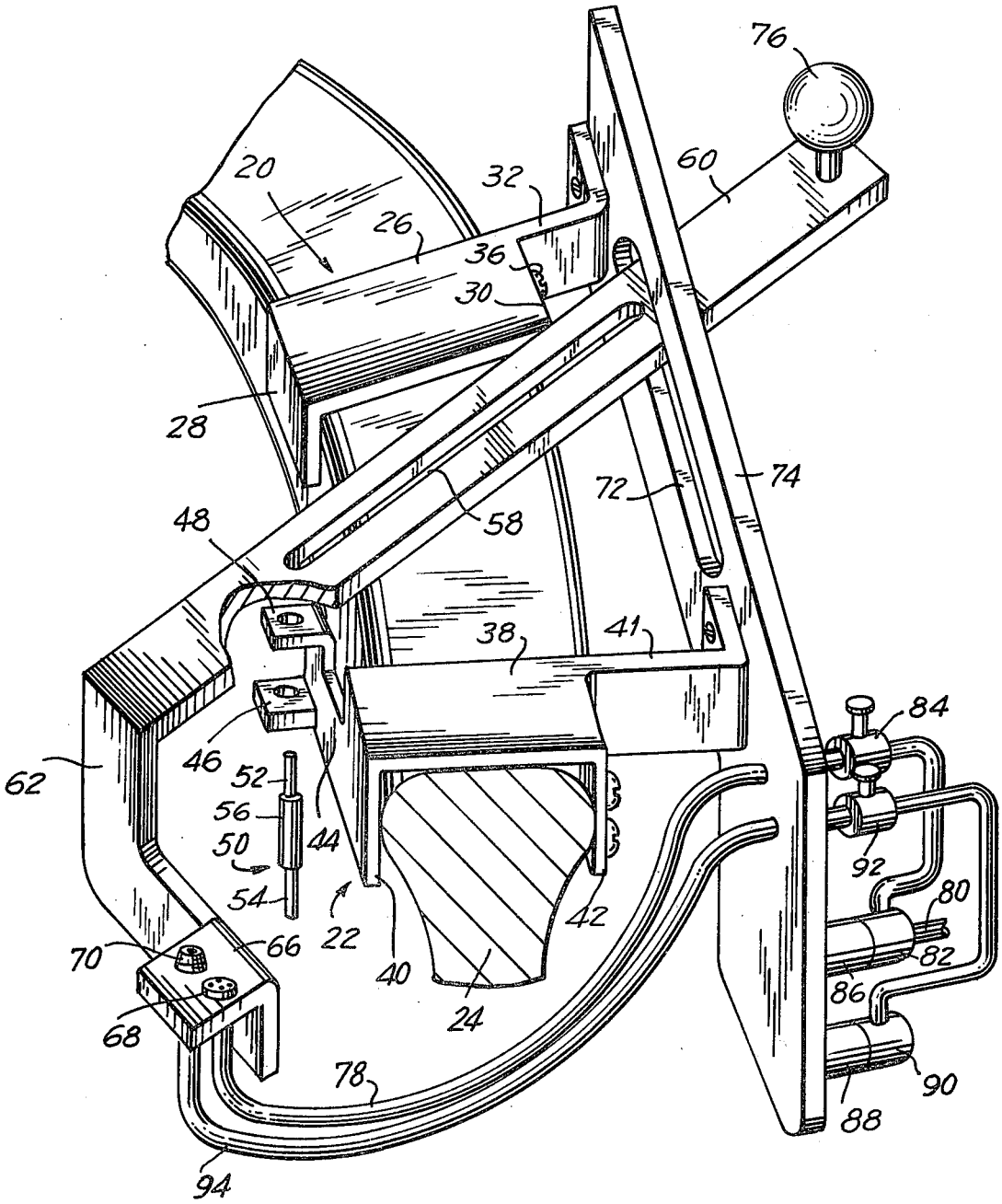
FIG. 1 is a perspective view and shows the arrangement of the present invention when installed in place on the rim of a receptacle.
Figure 2:
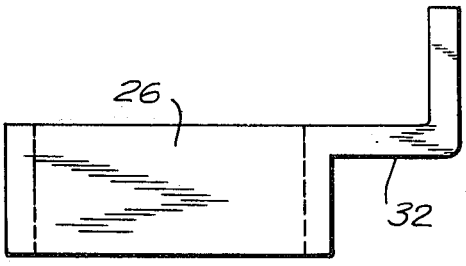
FIG. 2 is a top view of one of the brackets used in FIG. 1.
Figure 3:
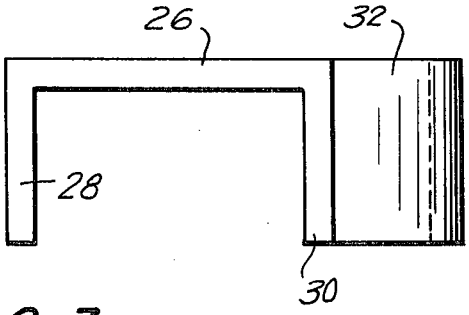
FIG. 3 is a front view of the bracket of FIG. 2.
Figure 4:
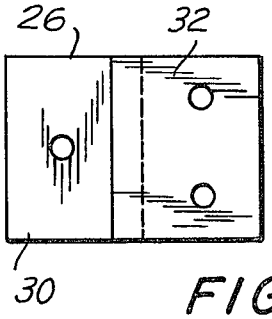
FIG. 4 is a side view of the bracket of FIG. 3.
Figure 5:
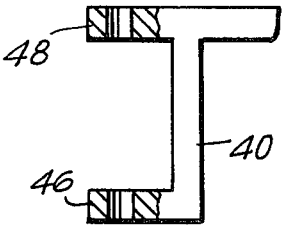
FIG. 5 is a front view of another one of the brackets of the arrangement of FIG. 1.
Figure 6:
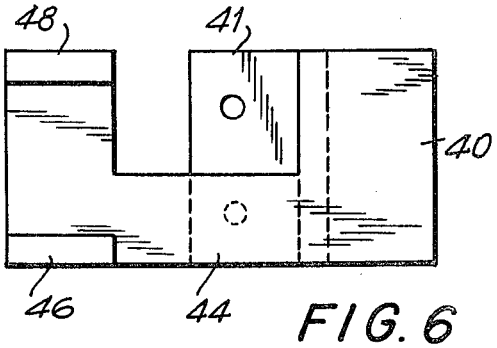
FIG. 6 is a side view of the bracket of FIG. 5.
Figure 8:
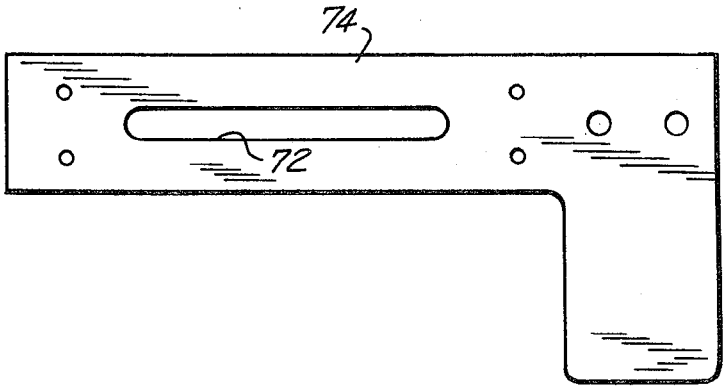
FIG. 8 is a front view of a supporting member used in the assembly of the arrangement of FIG. 1.
Figure 7:
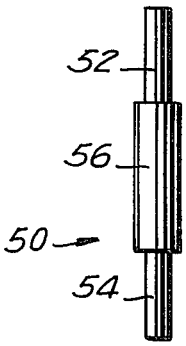
FIG. 7 is a plan view of a pivoting member supported by the bracket shown in FIGS. 5 and 6.
Figure 9:
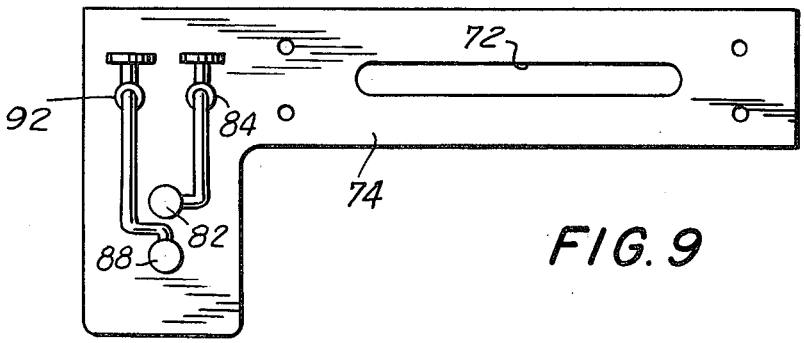
FIG. 9 is a rear view of the support of FIG. 8.
Figure 10:
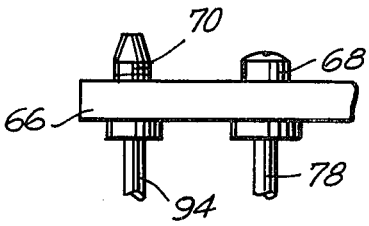
FIG. 10 is a partial front view of a supporting element used to support the spray of cleansing fluid and stream of air.
Figure 11:
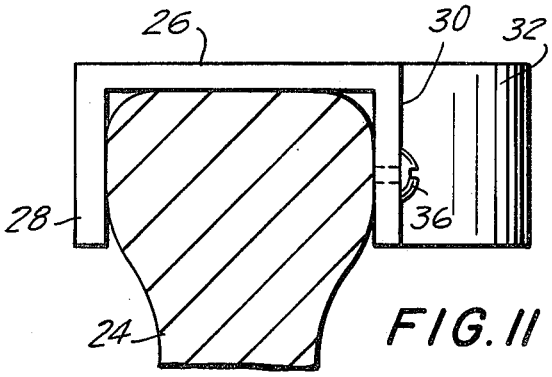
FIG. 11 is a partial sectional view and shows a further embodiment for mounting the arrangement of the present invention to the top rim of a receptacle.
Figure 12:
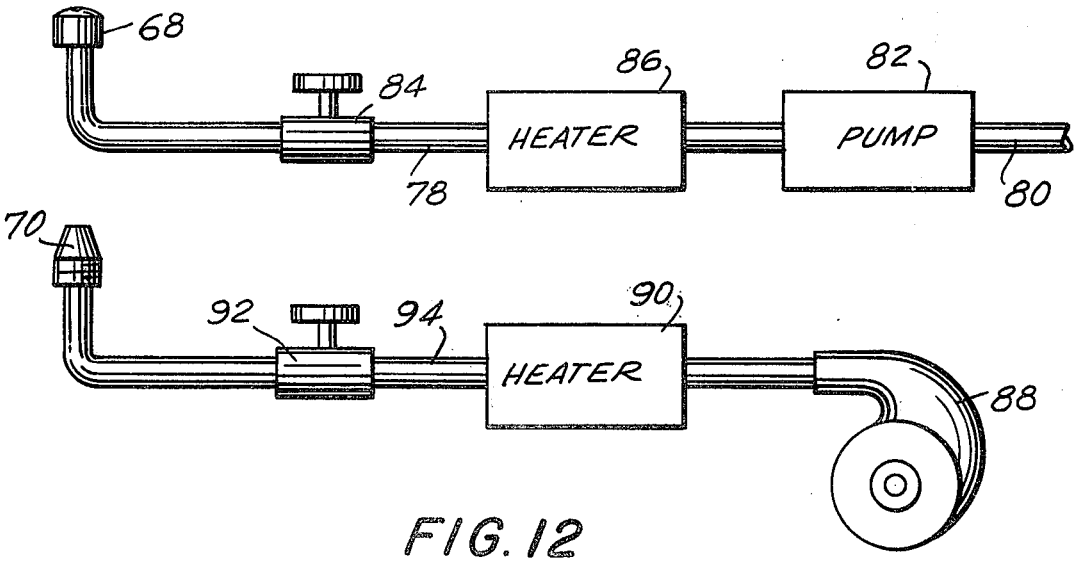
FIG. 12 is a schematic view and shows means for heating and applying pressure to the cleansing fluid and stream of air.

Referring now to the drawing, there is provided in accordance with the present invention, brackets 20 and 22 fastened to the upper rim of a toilet bowl 24. The bracket 20 has a portion 26 passing over the top surface of the rim of the toilet bowl. Extending at substantially right angles to the portion 26, are downward-directed portions 28 and 30. These portions 28 and 30 may be integrally formed with the portion 26, or they may be attached thereto. At the same time, the portion 26 may be a substantially flat-shaped portion passing over the upper rim of the toilet bowl 24, or it may have imparted thereto a slight curvature to conform to the profile or curvature of the upper rim surface of the toilet bowl. The combination of the portions 26, 28 and 30 form a substantially U-shaped element.

Projecting from the downward-directed portion 30 is an angled portion 32 which has an L-cross-section. The portion 32 may be formed integrally with the portion 30 and the remainder of the bracket 20, or it may be attached thereto by conventional fastening means.

The bracket 20 is fastened securely to the top rim of the toilet bowl 24, by means of screws 36 passing through threaded openings in the portion 30. The screws 36 apply pressure to the exterior surface of the rim of the toilet bowl, whereas the portion 28 applies pressure to the interior surface of that rim, and thereby grip firmly against the rim so that the bracket 20 is held securely in place.

The bracket 22 has portions 38, 40 and 42 substantially similar to the portions 26, 28 and 30, respectively, of bracket 20. At the same time, a pivot portion 44 extends from the downward-directed portion 40 of the bracket 22. This pivot portion 44 has a bored lower element 46 which is spaced from a similar bored upper element 48. The two bored elements 46 and 48 serve as bearing supports for a pin 50 which has upper and lower portions 52 and 54, respectively, seated within the bores of the elements 48 and 46, respectively. The central portion 56 of the pivoting pin 50 is held within the space between the elements 46 and 48, and bears against the top surface of the element 46.

The upper portion 52 of the pivoting pin 50, passes through the bore of element 48 and extends into a slot 58 of a lever 60. The latter is a substantially bar-shaped member passing over the top rim of the toilet bowl 24 and having, at one end, a downward directed portion 62 connected to a horizontal arm 64 which, in turn, terminates in an angled portion 66. The latter portion 66 serves as a support for a spray head 68 for applying cleansing water or fluid. Located adjacent to the spray head 68 is an outlet head 70 for applying drying air.

The downward-directed portion 62 extends sufficiently into the interior of the toilet bowl 24 from the top rim surface, so that the heads 68 and 70 are located at a comfortable distance below the posterior of the user.

The other end of the lever 60 is supported by a slot 72 of a plate-shaped member 74. This plate member 74 is attached to portions 32 and 41 of the brackets 20 and 22, respectively. The plate 74 may be attached to the portions 32 and 41 of the respective brackets, by means of screws or other conventional fastening means. The end of the lever 60 projecting through the slot 72 of the plate member 74, is provided with a knob 76 which may be gripped manually for purposes of manipulating the lever 60.

Thus, in practice, the lever 60 rests on the top surface of the element 48 and on the lower surface of the slot 72. The upper surface of the slot 72 prevents the lever 60 from tipping upward about the pivot assembly 48.

The downward-direction portions 28, 30, 40, and 42 may have imparted to them curvature conforming to the surface profile of the rim of the toilet bowl 24. At the same time, however, these downward-directed portions may also be substantially elements with flat surfaces bearing against the top rim of the toilet bowl.

From the geometry of the arrangement, in accordance with the present invention, it may be seen that by applying manipulative motion to the knob 76, it is possible to apply both rotational and translational motion to the portion 66 of the lever 60, which carries the heads 68 and 70. Accordingly, by appropriate motion of the knob 76, it is possible to effectively cover the complete surface of a user's posterior. In particular, it is possible to apply motion which scans, in effect, the surface of the posterior.

When the cleansing procedure by the user has been completed, the device of the present invention may be moved so that the portion 66 carrying the heads 68 and 70 are brought close to the interior wall of the toilet bowl directly beneath the internal edge of the toilet seat. In this manner, the open area of the toilet bowl is left free for use in the conventional way, and the device of the present invention does not become soiled during use of the toilet.

Cleansing water may be delivered to the spray head 68 by means of flexible tubing 78 leading directly to a water supply line 80 which provides water at conventional pressure generally experienced when opening a faucet in a bathroom, for example. In the event that the water supply line 80 cannot provide sufficient pressure to result in an effective water spray, then a pump 82 may be connected in series with the supply line 80 and the flexible tubing 78 for the purpose of applying sufficient pressure to the water spray emerging from the head 68.

In an advantageous embodiment of the present invention, a throttling valve 84 may be connected in series with the flexible tubing 78, for example, so as to control the applied pressure of the water spray so as to be comfortable to the user. Thus, the pump 82 or water supply line 80 may provide a predetermined maximum water pressure, and this pressure may then be reduced or throttled by means of the valve 84, for the purpose of adapting to the specific requirements of the individual user.

To render the water spray further comfortable to the user, the water as obtained from a fresh water supply line 80 may be heated by means of a conventional heating device 86 which may be in the form of an electrical resistance coil surrounding, for example, a coiled tube through which the water to be heated is directed. Such heating devices as the unit 86 for heating water, are well known in the art, and is for this reason not described in further detail here.

The stream of drying air supplied to the outlet head 70, may be supplied from a compressor 88 which, in a simple design, may be in the form of a blower or other conventional rotary device capable of supplying air under pressure. For the comfort of the user, the air stream may also be heated by the heater 90 which may also be of conventional form and similar to the heater 86 described above. Furthermore, the air stream may be supplied at a predetermined maximum level of pressure by the compressor or blower 88, and the pressure may then be reduced to any desired level by means of a further throttling valve 92 connected in series with the flexible tubing 94 supplying the air stream to the outlet head 70. With the valve 92, it is possible to adjust or set the pressure of the air stream to suit the individual requirements of the user.

The pump 82, compressor 88 and heaters 86, 90 may be conveniently mounted on an extension of the plate member 74. This plate member may also serve as a convenient support for the valves 84 and 92, as well as the flexible tubes 78 and 94. It is also possible to combine heaters 86 and 90 in an advantageous manner, so that only one of such units is then required.

The valves 84 and 92 may be in the form of simple manually controlled valves similar to those used in bathroom fixtures, for example.

Whereas the pin shaped pivot member 50 may be arranged with respect to the bearing elements 46 and 48 so that the central portion 56 may be located between these elements 46 and 48, it is also possible to provide that the portion 56 rests on top of the element 48, whereas the lower portion 54 passes through the openings of both the elements 46 and 48. The upper portion 52 then passes through the slot 58, and the under surface of the lever 60 bears against the top surface of the portion 56.

Figure 13:
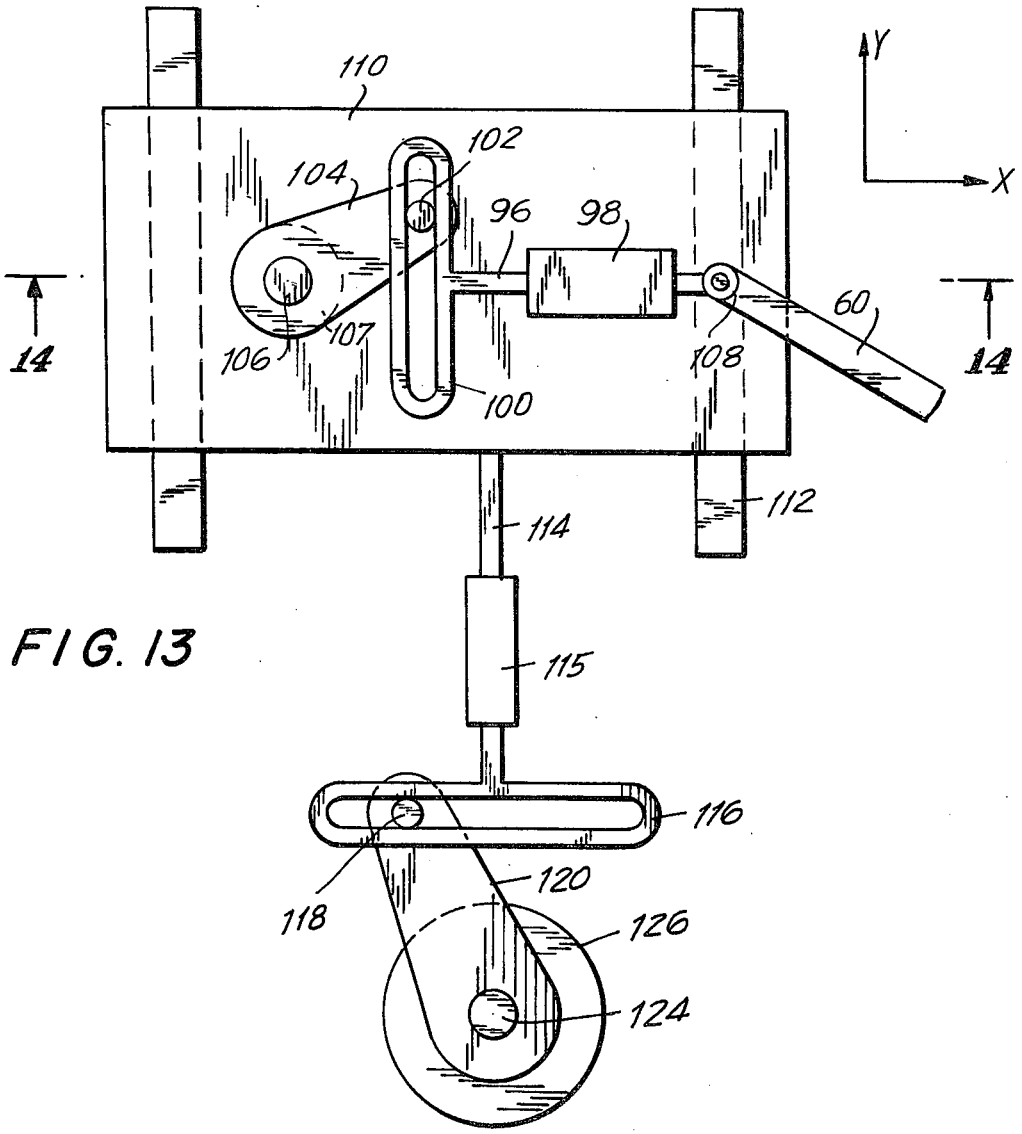
FIG. 13 is a plan view of a device used for applying reciprocating motion to the spray of cleansing fluid and stream of drying air.
Figure 14:
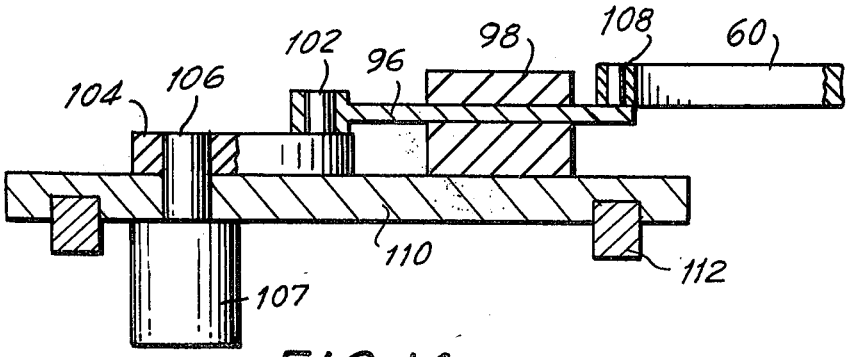
FIG. 14 is a sectional view taken along line 14—14 in FIG. 13.

In a further embodiment of the present invention, manipulation of the knob 76 for applying movement to the lever 60, may be replaced by mechanical means as shown in FIGS. 13 and 14. In this embodiment, the end of the lever 60 in the vicinity of the knob 76, is pivotally connected to the reciprocating rod portion 96 sliding within a fixed bearing 98 in a direction along the axis of the rod portion 96. The latter is connected to a slotted portion 100, so that the length of the slot is substantially perpendicular to the diredtion of motion of the rod portion 96. Within the slot of the portion 100, furthermore, rides a pin 102 attached to an eccentric arm 104. The latter is fixed to a shaft 106 driven by a motor 107. The combination of the elements 96, 98, 100, 102, 104, 106 is often referred to in the art as a scotch yoke. It may be seen from the arrangement of FIG. 13, that upon rotation of the shaft 106, the rod portion 96 will move in a reciprocating manner within the bearing 98. Such reciprocating motion is obtained from the action of the pin 102 in riding within the slot of the portion 100, as the eccentric arm 104 rotates continuously with the shaft 106.

The movement of the rod portion 96, as described above, may be designated as motion along a coordinate axis such as the X axis, for example. To effectively cover the area of the posterior, it is essential to apply motion in both X and Y directions, to the joint 108 between the end of the lever 60 and the end of the rod portion 96.

Motion in the Y direction is obtained by applying motion to the supporting plate 110, in the direction of right angles to the motion described with respect to the rod portion 96 above. The supporting plate 110 supports the entire assembly of elements 96 to 108, as shown in FIG. 14.

The supporting plate 110 is freely slidable on stationary guides 112, and is connected fixedly to a further rod portion 114, which is similar to the rod portion 96. The rod portion 114 is, in turn, connected to a slotted portion 116 which cooperates with a pin 118 attached to a second eccentric arm 120. The latter is fixed to a shaft 124 driven by a motor 126. The elements 114–126 are similar to the elements 96–107 described above with respect to the X direction. The relationship between the X and Y directions is shown in the plan view of FIG. 13.

Figure 15:
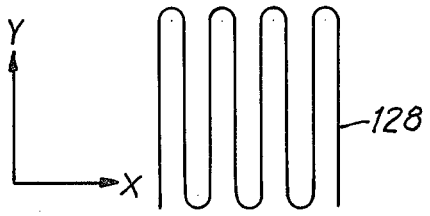
FIG. 15 is a diagrammatic view and shows the path of motion traced by the spray of cleansing fluid and stream of drying air when operating in conjunction with the arrangement of FIGS. 13 and 14.

Consequently, by operating both motors 107 and 126, it is possible to apply motion in both X and Y directions to the joint 108. With motion applied in directions along a coordinate set of axes, the area exposed by the opening of the toilet bowl may be effectively covered. Furthermore, it is not essential to operate motors 107 and 126 at the same speeds. By operating the motor 126 at substantially greater speed than the motor 107 so that the rod portion 114 is reciprocated at a greater rate than the rod portion 96, for example, the absolute motion of the joint 108 may be made to trace a path 128, as shown in FIG. 15. In this path 128, the joint 108 is reciprocated through a larger number of cycles along the Y direction than the X direction. In this manner, the area at the top of the toilet bowl, and hence the posterior of the user, can be covered in an effective manner, by applying both the water spray and the drying air to all locations of the area. The arrangement of FIGS. 13 and 14, moreover, make it possible to carry out the cleansing and drying operation in a particularly free period of time. Thus, the motors 107 and 126 may be operated sufficiently rapidly to perform the cleansing and drying operation in less time than required when using conventional methods.

Figure 16:
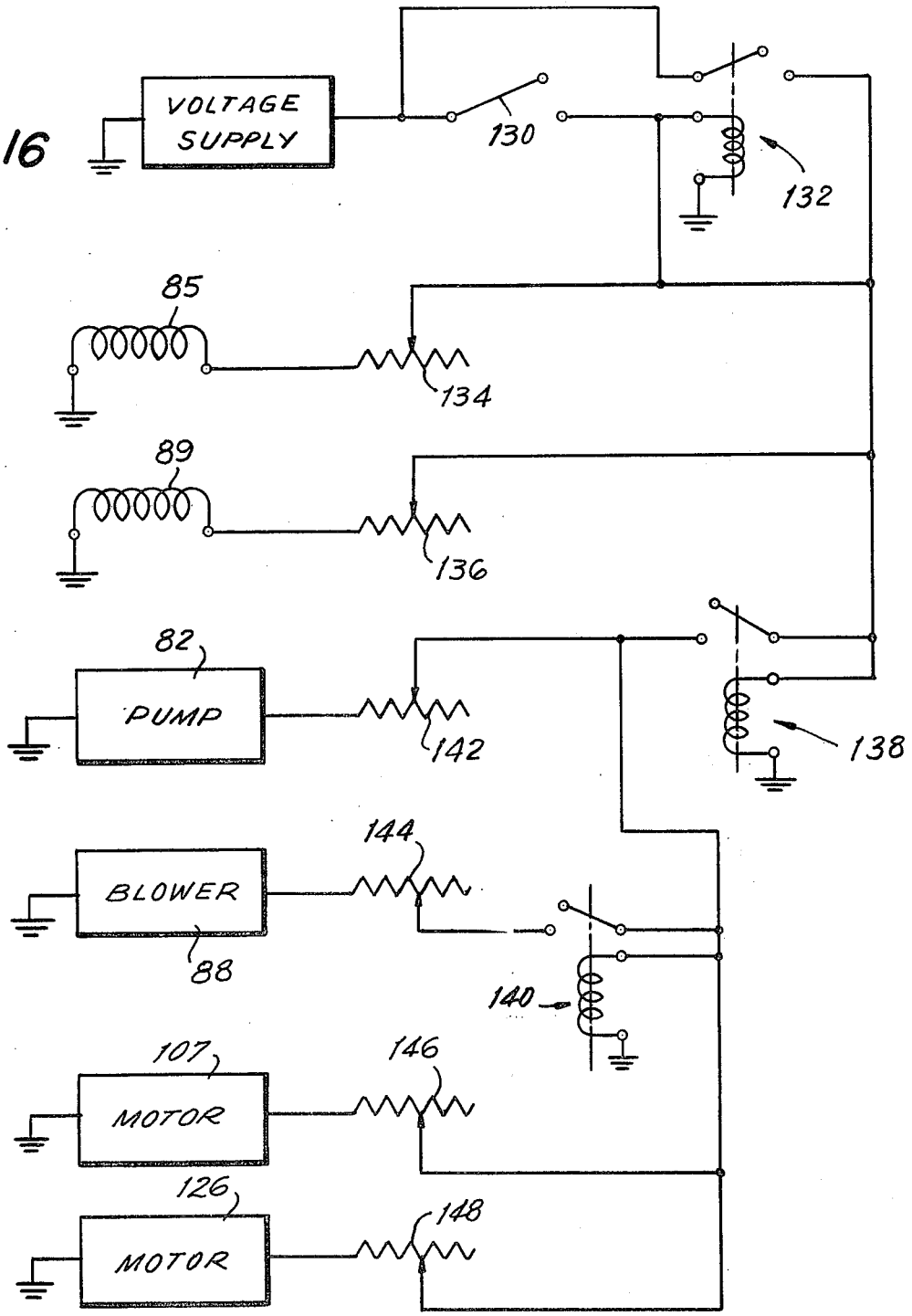
FIG. 16 is an electrical schematic and shows the interconnections for controlling the components for carrying out the method and objects of the present invention.

In operation of the present invention, the operating components are controlled in accordance with the electrical schematic shown in FIG. 16. To initiate a cleansing cycle, push-button 130 is actuated by the user. In the event that the user is an invalid who is not able to perform this operation, the push-button 130 may be actuated by an attendant. The closure of push-button 130 actuates a time delay relay 132 which closes immediately upon actuation of the switch 130 and applies power to coils 85 and 89 of heaters 86 and 90, respectively. The temperature to which the cleansing water and drying air are heated, may be adjusted to suit the individual requirements, by the setting of variable resistors or rheostats 134 and 136, respectively.

When time delay relay 132 applies power to the coils 85 and 89, it also applies a signal to a second time delay relay 138 which closes a predetermined time interval after the heaters 86 and 90 are in operation by means of their respective coils 85 and 89. After this predetermined time interval, relay 138 closes and applies power to operate the pump 82. This pump then serves to apply a spray of heated water to the posterior of the user. Time delay relay 138 assures that the water is heated to a comfortable temperature prior to operating the pump and applying the water spray.

After pump 82 has been set in operation, and the water spray has been applied effectively over the required area of the toilet opening, time delay relay 140 closes the circuit to the air blower or compressor 88. Thus, time delay relay 140 becomes first actuated after a predetermined time interval which assures that the water spray has been applied for a sufficiently long period of time to result in proper cleansing.

The pressure of the applied water spray may be adjusted by the setting of the variable resistor or rheostat 142. Similarly, the intensity or pressure of the applied air stream for drying the wetting areas may be adjusted by the setting of the variable resistor 144.

Motors 107 and 126 are operated at the same time as the pump 82, and the individual speeds of these motors may be selectively adjusted by means of their respective variable resistors or rheostat 146 and 148.

After the lapse of a time interval which assures that both cleansing and drying operations have been effectively carried out, the time delay relay 132 breaks the circuit by becoming released, and a cleansing and drying cycle has been completed. Thus, relay 132 is of the construction where this relay will close the circuit upon applying a signal to the coil of this relay, and will therefore become released after the expiration of a predetermined time interval. The construction and apparatus of such relays 132, 138, 140 are well known in the art, where they are often referred to as time delay relays, and for this reason are not described in further detail here.

The arrangement of the present invention may be applied in a substantially equally advantageous manner to the top rim of a bidet type of basin, as well as a toilet bowl. The top rim of such a bidet receptacle may have substantially the same shape as the toilet bowl, for example. Accordingly, the brackets 20 and 22 may be used for installation in bidet type of receptacle also. Such a conventional bidet receptacle may include stoppers for retaining the water within the receptacle, as well as provision for applying soaping and other pharmaceutical agents.

Figures 17, 18:
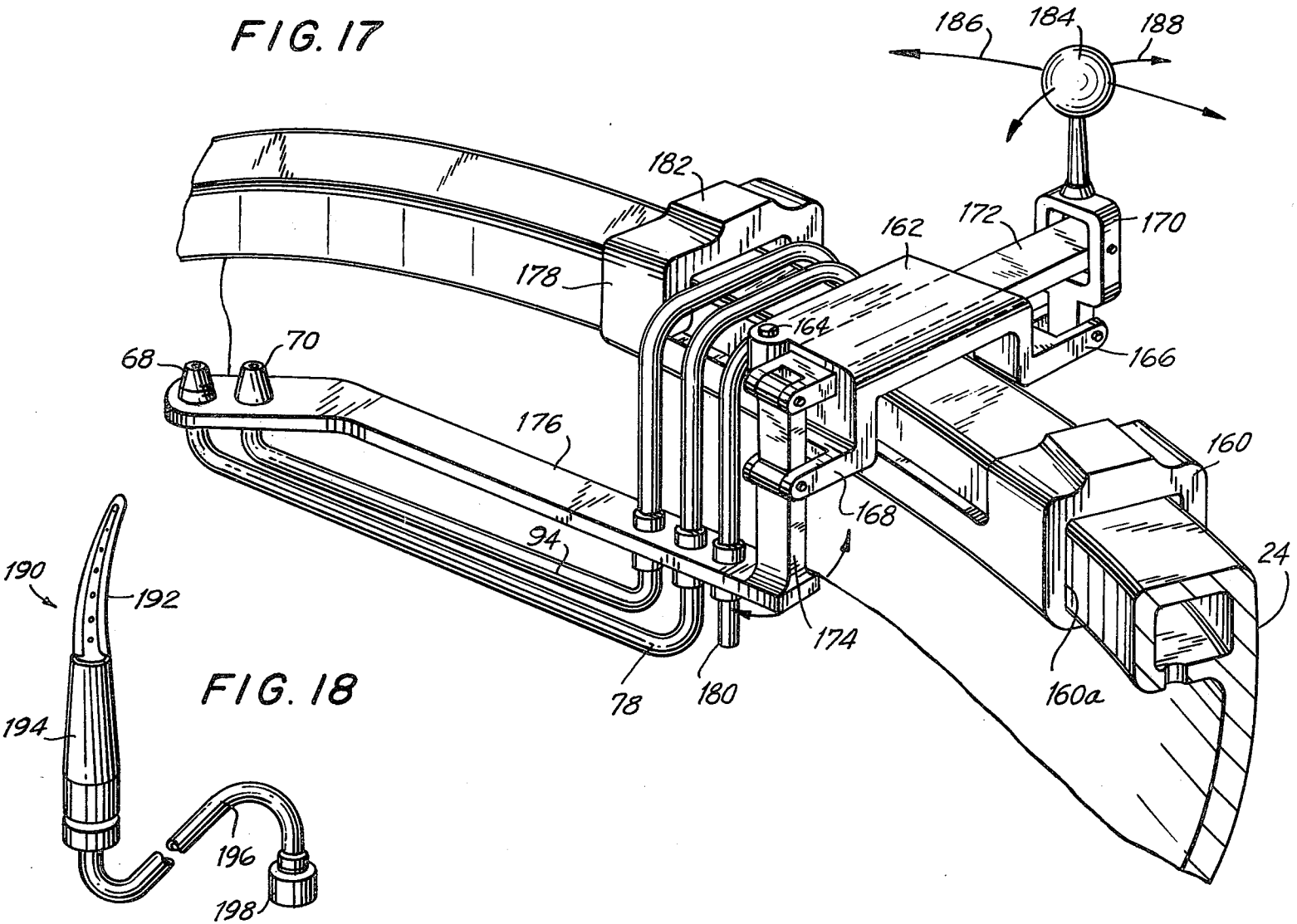
FIG. 17 is a perspective view of another embodiment of the present invention.
FIG. 18 is a perspective view of a douche attachment applicable to the several embodiments of the present invention.

In accordance with another embodiment of the present invention, a bracket member 160, shown in FIG. 17, is fastened to the rim of the toilet bowl 24. The bracket 160 is made of molded plastic material which has flexible characteristics which cause the material to retain its molded shape. The molded plastic bracket 160 may, thereby, be snapped onto the rim of the toilet bowl, and held there in place without requiring further fastening means. The internal surface **160*a* of the bracket 160 is dimensioned substantially smaller than the external surface of the rim of the toilet bowl, so that when the bracket 160 is pushed in place onto the rim of the toilet bowl, the resultant pressure between the internal surface 160*a* and the exterior surface of the rim of the toilet bowl serves to hold the bracket firmly in place. In accordance with this arrangement, the bracket 160** may also be easily removed from the toilet bowl, and snapped back on as desired.

Pivoted on the bracket 160, is a plastic molded transverse member 162. This member straddles the rim of the toilet bowl, and is pivoted on the bracket 160 by means of the pivot pin 164. The transverse member 162 has a substantially U-shaped cross-section which allows the member to conform to the shape of the top rim of the toilet bowl. The transverse member 162, furthermore, has extending leg portions 166 and 168 on the outside and inside, respectively, of the toilet bowl. Pivoted on the leg portion 166, is a handle portion 170 which carries a bar 172 slidable within a slot of the member 162. One end of the bar 172 is pivotally connected to the handle member 170, whereas the other end of the bar 172 projecting toward the interior of the toilet bowl after emerging from the slot in the member 162, is linked to a lever portion 174. This lever portion is pivoted at the end of the leg portion 168.

Secured to the bottom end of the lever portion 174, is a supporting arm 176 which carries the water spray head 68 an the air outlet head 70. Directly beneath the supporting arm 176, are located the flexible conduits or tubes 78 and 94 which conduct the water and air to the respective heads 68 and 70. The extensions of these conduits or tubes pass directly over the rim of the toilet bowl to the exterior thereof. Whereas FIG. 17 shows these extended portions of the tube to be passing over the rim of the toilet bowl within a cutout space in the bracket 160, these tubes may also pass over the rim of the toilet bowl adjacent to outside end 178 of the bracket 160, for example.

In addition to carrying the tubes 78 and 94, the supporting arm 176 also provides for a third tube 180 out of which passes a downward directed stream of the water admitted into the tube 78. The purpose of the tube 180 is to permit the user of the device to test the temperature of the water to assure comfortable usage of the device. Thus, the user of the device may simply pass a hand beneath the outlet of the tube 180, and thereby check the temperature of the water to be directed out of the spray head 68.

The top surfaces 182 of the bracket 160 are flattened to form bearing surfaces for the toilet seat. Accordingly, when the toilet seat is in place on the toilet bowl, the transverse member 162 is substantially covered by the toilet seat.

In operation of the embodiment of FIG. 17, the user manipulates the handle portion 170 by gripping the spherical portion 184 attached thereto. By moving the gripper portion 184 in the direction of the arrow 186, the transverse member 162 is caused to rotate about the pivot pin 164 and thereby rotate the supporting arm 176 from a stowed position to a central position, for example, within the opening of the toilet bowl. When in the stowed position, the supporting arm 176 together with the heads 68 and 70 are in close proximity to the interior wall of the toilet bowl directly beneath the rim thereof, so as to leave the opening of the bowl substantially free. By thus moving the gripper portion 184 in the direction of the arrow 186, the heads 68 and 70 may be moved over a substantial area of the bowl opening.

To cover the area of the bowl opening effectively, there is provided in accordance with the present invention, that the heads 68 and 70 may be moved transversely to the direction which corresponds to movement resulting from displacement of the gripper 184 in the direction of the arrow 186. This is achieved by moving the gripper 184 in the transverse direction 188. When moving the gripper 184 in this direction of the arrow 188, the handle portion 170 pivots about the leg portion 166 and thereby displaces the bar member 172 within the slot of the transverse member 162. Such displacement of the bar 172 causes the lever portion 174 to pivot about the leg portion 168. As a result, the heads 68 and 70 at the end of the supporting arm 176 attached to the lever portion 174, become displaced along an arc-shaped path having a direction substantially perpendicular to the displacement of the heads resulting from moving the gripper 184 in the direction of the arrow 186. Substantial play is allowed between the bar 172 and the slot in the transverse member 162 to allow the gripper 184 to move freely in the direction of the arrow 188. The flexibility of the plastic material used to mold the transverse member 162 also contribute to allowing the gripper portion 184 to move freely in the desired directions, under manipulation of the user.

In the construction of the embodiment of FIG. 17, the parts are constructed of molded dielectric non-porous plastic material which may be readily cleaned with caustic agents.

In conjunction with the water spray head 68, there is provided in accordance with the present invention, a douche attachment 190 shown in FIG. 18. The latter has a water outlet spray portion 192 joined to a gripping portion 194 which permits the user to insert the douche. The gripper portion 194 is internally hollow to allow water to pass from the flexible tubing 196 to the outlet portion 192. The tube 196 is connectable to the head 68 by means of an internally threaded screw cap member 198. The water outlet head 68 is correspondingly threaded to receive the cap member 198.

Figure 19:
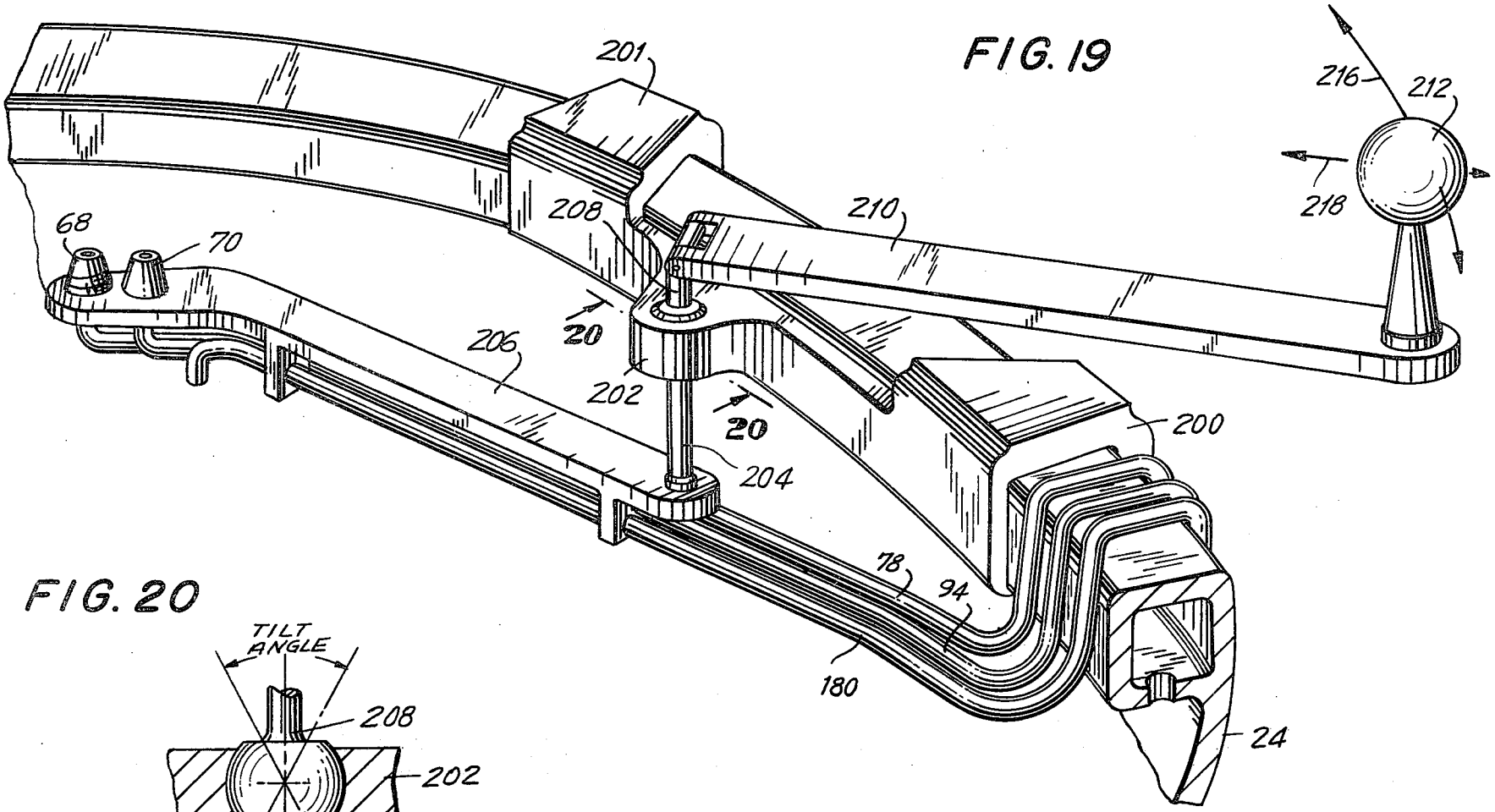
FIG. 19 is a perspective view of a further embodiment of the present invention.

In accordance with a further embodiment of the present invention, shown in FIG. 19, a bracket member 200 fabricated of molded plastic material is fastened to the rim of the toilet bowl 24 by being snapped on in a manner similar to that described in relation to the bracket 160 in FIG. 17. The bracket 200 has a pivot portion 202 for supporting a vertically-oriented bar or shaft member 204. The lower end of the member 204 carries a supporting arm 206 which, in turn, carries the water spray head 68 and the air outlet head 70. The arm 206 also carries the water and air supply tubes 78 and 94, respectively, as well as the tube 180 which allows the user to test the temperature of the water.

Connected to the lower shaft portion 204, is an upper shaft portion 208 which is pivotally connected to a transverse bar member 210. The end of the bar member 210 extending to the outside of the bowl 24, has attached thereto, a spherically-shaped gripping portion or knob 212.

Figure 20:
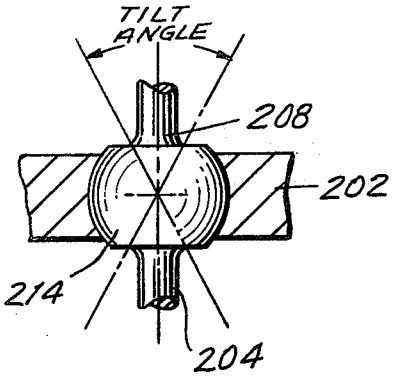
FIG. 20 is a partial sectional view taken along line 20—20 in FIG. 19.

The shaft portions 204 and 208 are connectecd by means of a ball joint portion 214 shown in FIG. 20. The ball joint portion 214 is seated within the portion 202 of the bracket 200, so that the ball joint and hence shaft portions 204 and 208 may tilt through a range of angular displacement corresponding to the displacement of the end of the shaft 208 linked to the bar 210.

The construction of the linkage between the shaft portion 208 and the bar member 210, is shown in FIG. 21. The top end of the shaft portion 208 is T-shaped and contains a bore 209 for receiving a pin 211. The bar 210 has a fork-shaped end which contains bores 213 and mates with the T-shaped end of the shaft portion 208. When the fork-shaped end of the bar 210 is assembled in place to the T-shaped end of the shaft portion 208, the pin 211 passes through the bores 213 and 209, whereby the bar member 210 is pivotally linked to the end of the shaft portion 208.

In operation of the arrangement shown in FIG. 19, the heads 68 and 70 may be moved from a stowed position beneath the rim of the toilet bowl to a substantially central position of the bowl opening, for example, by moving the gripper or knob 212 in the direction of the arrow 216. The movement of the knob 212, in this manner, causes rotation of the shaft portions 208 and 204, and thereby the rotation of the supporting arm 206. Movement of the knob 212, therefore, permits the user to sweep the heads 68 and 70 across the opening of the bowl. Movement of the heads 68 and 70 transversely to the path swept by displacing a knob 212 in the direction of arrow 216, is obtained by displacing the knob 212 in the direction of the arrow 218. Displacement of the knob 212 in the direction of the arrow 218, causes the bar member 210 to move transversely across the rim of the toilet bowl and thereby tilt the shaft portions 204 and 208 in the ball joint 214. Such tilting of the shaft portion 204 results in corresponding tilting of the supporting arm 206, so that the heads 68 and 70 become displaced along an arc-shaped path which is transverse to the path taken by the heads 68 and 70 when the knob 212 is moved in the direction of the arrow 216. Accordingly, the area of the bowl opening may be effectively traversed or scanned by moving the knob 212 in the directions of the arrows 216 and 218 which are oriented at substantially right angles with the other. The flexibility of the plastic molded material of the bracket 200 and pivot portion 202, permits the tilting action of the ball joint 214 to take place. The bar member 210 is, at the same time, held in place within the cutout portion of the bracket 200, when the toilet seat rests on the flattened portions 201 of the bracket 200. Thus, the flattened top surfaces of the bracket 200 serve as bearing surfaces 201 for the toilet seat which prevents the bar member 210 from being pivoted upwards during usage of the device.

The supporting arm 206, in accordance with the present invention, may be alternately constructed in the form shown in FIG. 22. In this embodiment, the supporting arm 207 is constructed of molded plastic material having three ducts 220, 222, 224. These ducts are used to conduct the water and air to the heads 68 and 70, respectively, as well as the test water which enables the user to test the water temperature. The construction of FIG. 22 allows the supporting arm and the ducts or passages for air and water to be of integral or one piece molded construction. FIG. 22, thereby avoids the necessity of providing separate tubing for the water and air.

A further alternate construction for the pivot portion 202 which holds the ball joint 214, is shown in FIG. 23. In accordance with this alternate construction, the bearing portion 226 attached to the bracket 200, include a V-shaped slot 228 which serves as a line of weakness which allows the pivot portion 226 to tilt readily with respect to the remainder of the bracket 200 attached to the rim of the bowl. The slot 228 provides for substantial freedom in movement for tilting the pivot 226, while avoiding the use of a ball joint.

Figure 24:
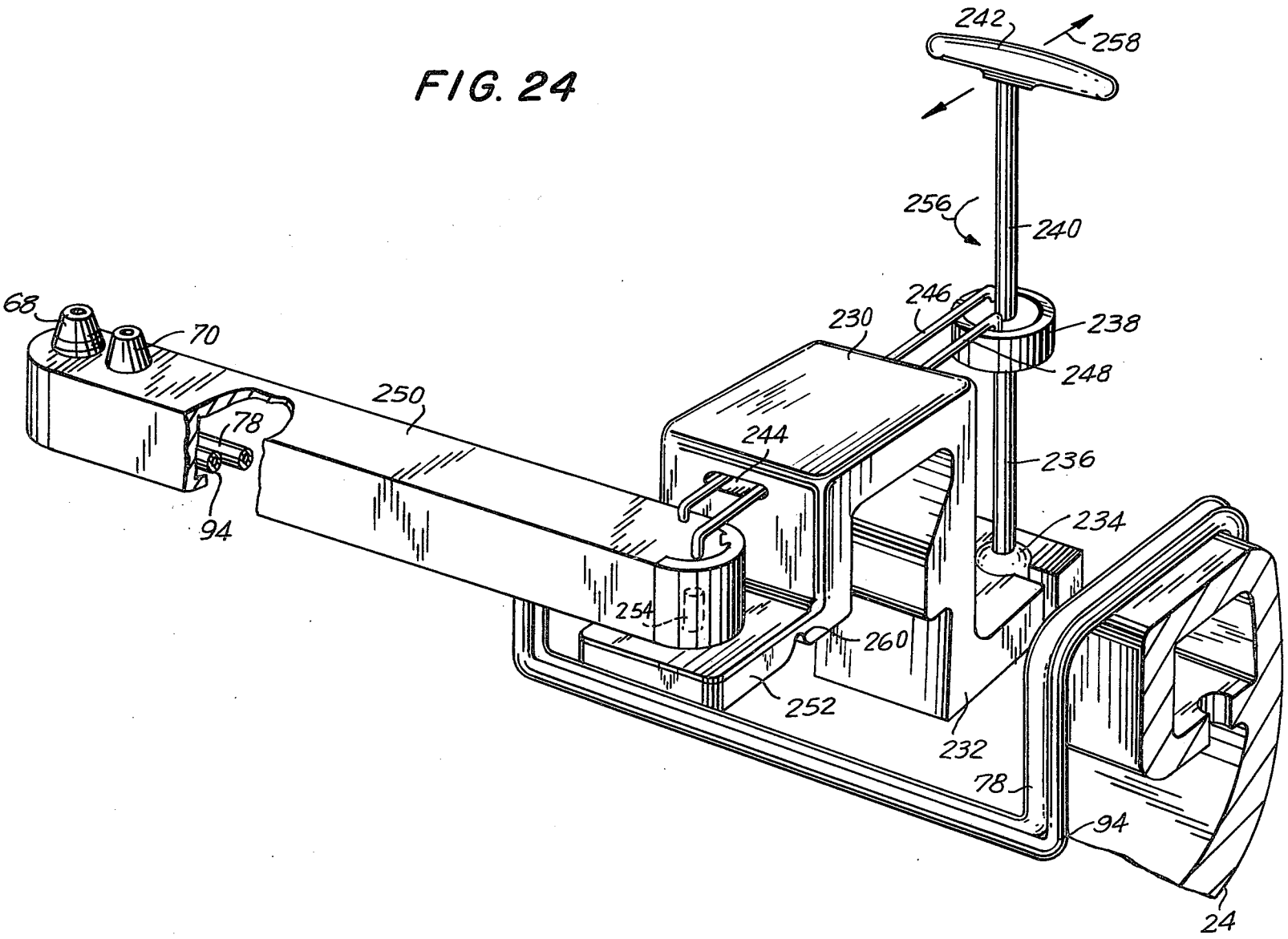
FIG. 24 is a perspective view and shows another embodiment of the present invention.

In accordance with a still further embodiment of the present invention, shown in FIG. 24, a bracket member 230 is made of molded plastic material and may be snapped onto the rim of the bowl 24, in a manner similar to that described in relation to the embodiment of FIG. 17. The bracket 230 has a leg portion 232 which serves as a support for a ball joint pivot 234. Connected to this ball joint 234, is a shaft member 236 carrying a disc-shaped portion 238 to which an upper shaft member 240 is connected. The upper end of the shaft member 240 is, in turn, connected to a gripping handle 242. The ball joint pivot 234 is similar in construction to that shown in FIG. 20.

The bracket 230 is provided with a slot 244 through which are passed two connecting rods 246 and 248. One end of each of these connecting rods has an angled portion extending into the disc-shaped element 238. The other end of each of the connecting rods, also has an angled portion extending into a supporting arm 250 which is pivotally mounted on the leg portion 252 of the bracket 230. A pin 254 attached to the leg portion 252 serves as a pivot for the supporting arm 250. The latter carries the water spray head 68 and the air outlet head 70. The arm 250 also serves as a support for the water and air supply ducts 78 and 94.

In operation of the arrangement of FIG. 24, the heads 68 and 70 may be moved from a stowed position directly beneath the rim of the toilet bowl, to a substantially central position of the bowl opening, for example, by rotating the gripping handle 242 in the direction of arrow 256. The rotation of the gripping handle 242 by the user, for example, causes rotation of the disc-shaped portion 238, so that the connecting rods 246, 248 rotate the arm 250 about the pivot pin 254 correspondingly. To move the heads 68 and 70 in the direction which is transverse to the path taken by the heads when the handle 242 is rotated in the direction of the arrow 256, the handle is displaced further in the direction of the arrow 258. The latter transverse motion of the handle 242, causes tilting of the shaft portions 240 and 256 in the ball joint 234. This tilting motion is communicated by the connecting rods 246, 248 to the supporting arm 250. The bracket 230 is constructed of flexible molded plastic material, so that the tilting motion of the arm 250 is freely permitted by the tilting action of the leg portion 252 with respect to the remainder of the bracket 230. To further facilitate tilting of the leg portion 252 with respect to the remainder of the bracket 230, a V-shaped notch 260 is provided on the leg portion 252 for the purpose of establishing a line of weakness and thereby allow free bending of the portion 252 and hence tilting of the arm 250. The tilting motion of the arm 250 causes the heads 68 and 70 to become displaced along an arc-shaped path which is transverse to the path of the heads taken when the handle 242 is rotated in the direction of the arrow 256. The resultant motions of the heads 68 and 70 allow the heads to effectively traverse or scan the bowl opening.

Figures 25, 26:
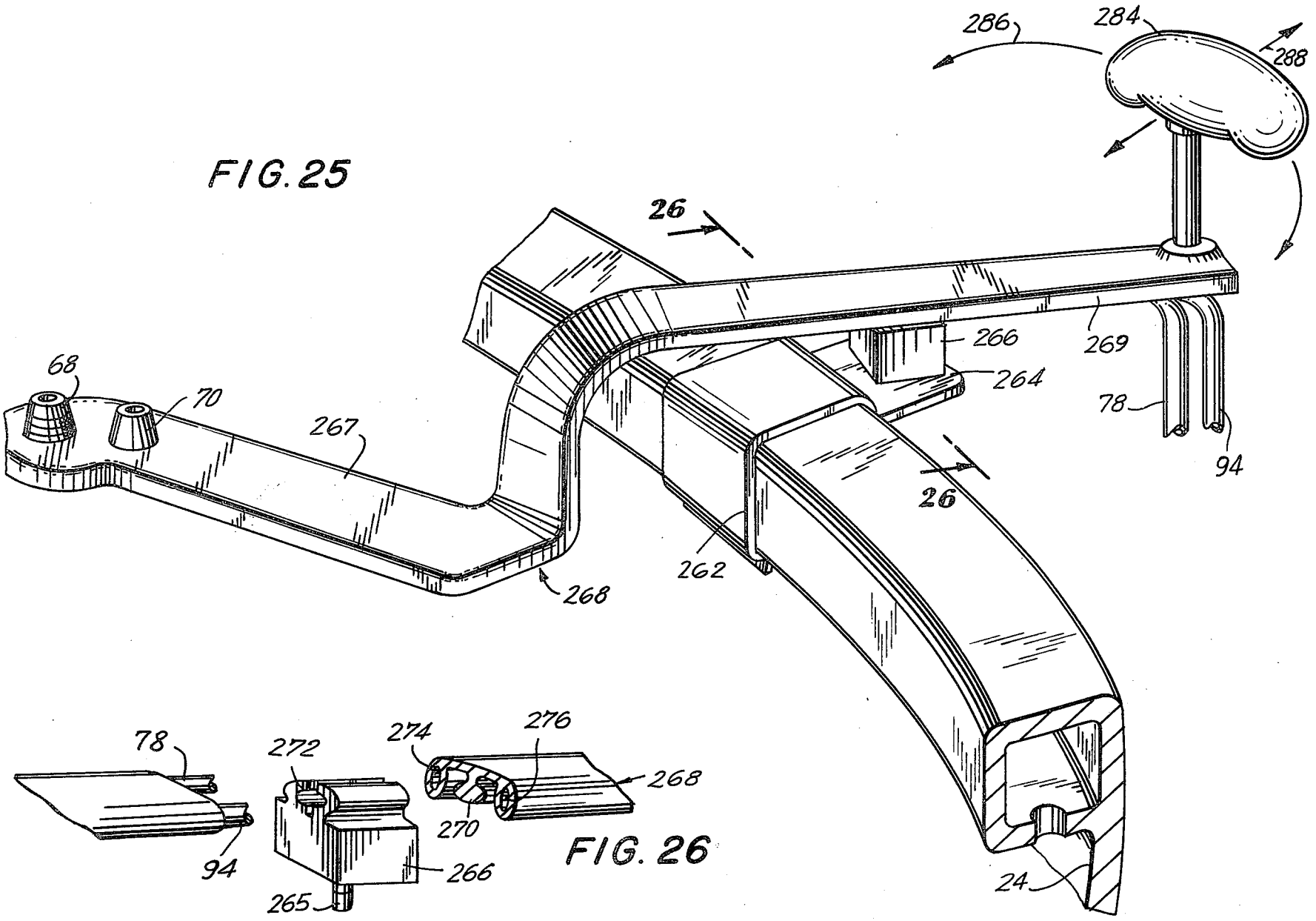
FIG. 25 is a perspective view of a still further embodiment of the present invention.
FIG. 26 is an exploded perspective view taken from the direction 26—26 in FIG. 25.
Figure 27:
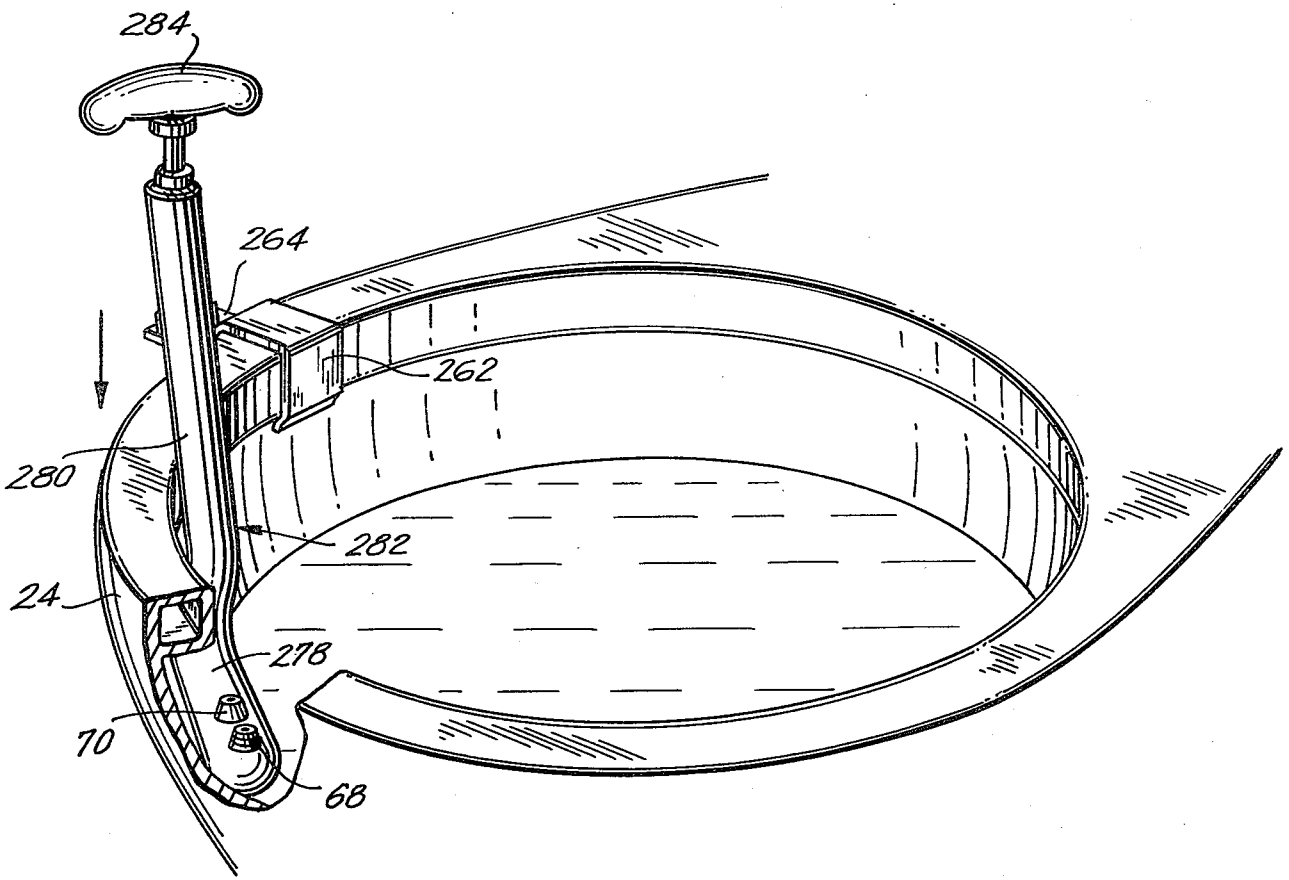
FIG. 27 is a perspective view and shows the arrangement of the embodiment of FIG. 25 when in stowed position.

A further embodiment of the present invention is shown in FIGS. 25–27. In this embodiment, a bracket 262 is snapped onto the rim of the bowl 24 in a manner already described. The bracket 262 has a supporting plate portion 264 which supports a bearing block 266. The bearing block 266 is pivotally held on the support 264. The bearing block 266, moreover carries an arm 268, at the end of which heads 68 and 70 are mounted.

The arm 268 is made of molded plastic material, and has a cross-section as shown in FIG. 26. The arm 268 has an internal longitudinal projecting rail portion 270 which is slidable within a groove 272 of the bearing block 266. The cross-sectional shape of the groove 272 conforms substantially to the cross-sectional shape of the rail portion 270. The molded plastic arm 268 is also constructed as a compact arrangement by providing openings 274 and 276 for the water and air supply lines 78 and 94, respectively.

The arm 268 may be constructed in the form shown in FIG. 25, in which the portion 267 within the interior of the bowl, is substantially offset with respect to the upper portion 269 passing over the rim of the bowl and extending to the exterior thereof. Thus, in the arrangement of FIG. 25, the portions 267 and 269 of the arm 268 are not coplanar. At the same time, however, the arm may be constructed in the form shown in FIG. 27, in which the portion 278 within the bowl is coplanar with the upper portion 280 of that arm 282 shown is stowed position in FIG. 27.

In operation of the embodiment shown in FIGS. 25–27, the user of the device can move the heads 68 and 70 from the stowed position shown in FIG. 27, to a substantially central position of the bowl opening, for example, by moving the gripping handle 284 in the direction of the arrow 286. During this motion, the bearing block 266 pivots on the plate portion 264 by means of the pin 265 passing through an opening of this plate portion 264. To move the heads 68 and 70 in a direction transversely to the patch of motion taken by these heads when moving the handle 284 in the direction of the arrow 286, the handle is moved further in the direction of the arrow 288. When thus moving the handle in the direction of arrow 288, the arms 268 or 282 slides longitudinally in the bearing block 266 and thereby provides the transverse movement which, when combined with the movement of the handle 284 in the direction of arrow 286, provides for effective coverage or scanning of the bowl opening.

When in the stowed position, the arm 268 or 282 may be positioned so that the heads 68 and 70 clear the bowl opening by being located directly beneath the rim of the bowl at the front side thereof, as shown in FIG. 27. It is equally advantageous, on the other hand, to position the arm 268 and 282 so that the heads 68 and 70 are located directly beneath the bowl rim at the back side thereof. The latter also results in a stowed position of the heads in which the bowl opening is left free and unobstructed when the device is not in use.

In the fabrication of the arms 268 or 282, it is essential that the upper surfaces of these arms be smooth, since these upper surfaces may come into contact with the posterior of the user during application of the device.

Figures 28, 29:
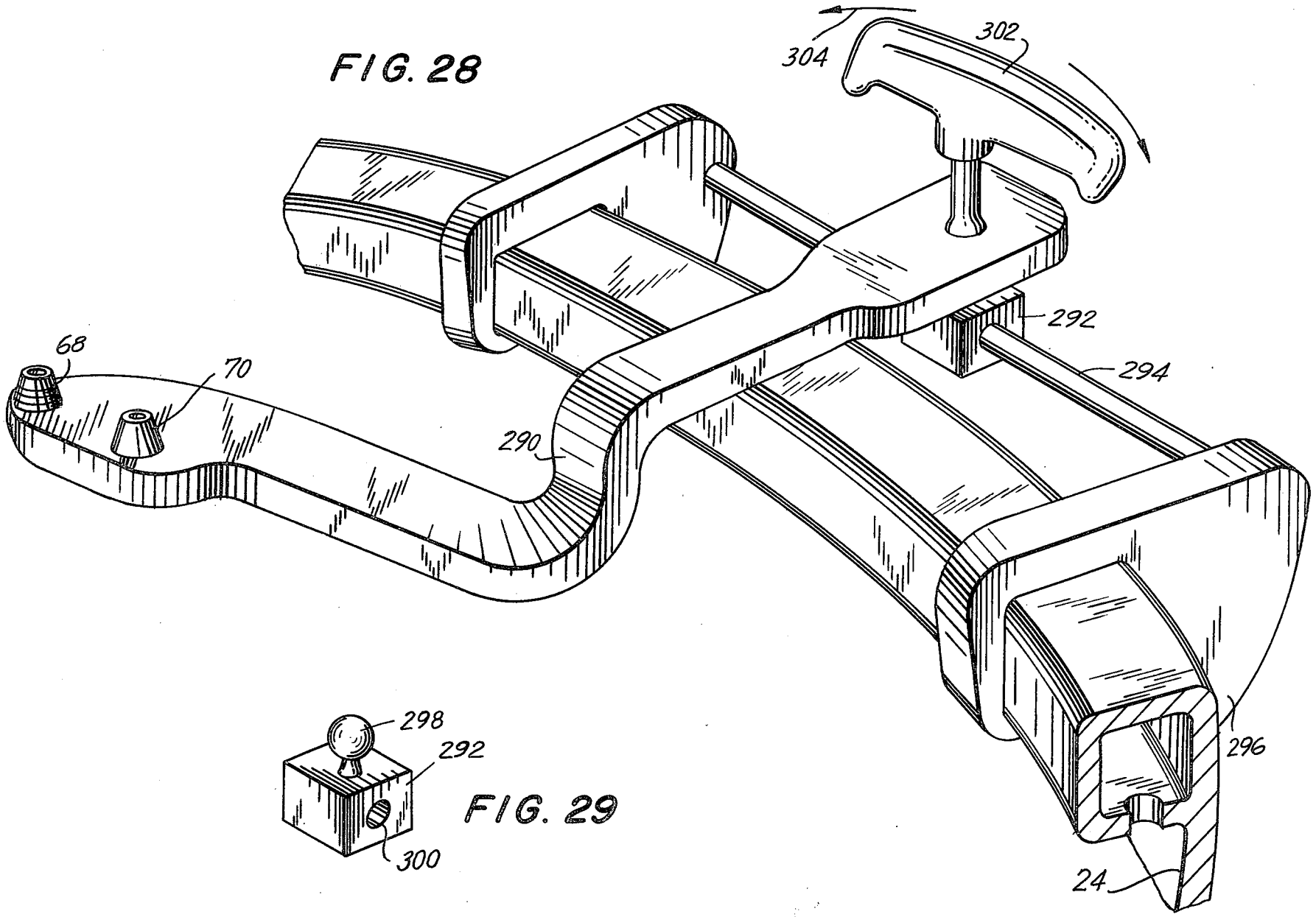
FIG. 28 is a perspective view and shows a further embodiment of the present invention.
FIG. 29 is a perspective view and shows the construction of a joint member used in the embodiment of FIG. 28.

In accordance with another embodiment of the present invention (FIG. 28), the heads 68 and 70 are carried by an arm 290 which is pivotally held by a bearing block 292. The latter is slidable along a shaft 294 supported by brackets 296 which may be attached or snapped onto the rim of the bowl 24. For this purpose, the bearing block 292 is constructed as shown in FIG. 29, in which the block has an opening 300 through which the shaft 294 extends. The bearing block 292 also has a ball joint 298 on which the arm 290 is pivoted in a manner already described above in relation to FIG. 20. The arm 290, furthermore, may be molded with openings therethrough for the purpose of providing conduits for the water and air supplied, in a manner similar to that shown in FIG. 22.

In the operation of the embodiment of FIGS. 28–29, the heads 68 and 70 may be moved from a stowed position to a substantially central location of the bowl opening, for example, by moving the gripping handle 302 along the rim of the bowl so that the block 292 slides along the shaft 294. This movement of the gripper handle 302 provides motion of the heads 68 and 70 in one direction. To obtain motion of the heads in a direction transversely to the first-mentioned direction, the handle 302 may be tilted by the user in the direction of the arrow 304. Such tilting action of the handle 302 causes the heads 68 and 70 to move along an arc-shaped path which is transverse to the path of the heads taken when the handle is moved so that the block 292 slides along the shaft 294. The resultant motions of the heads 68 and 70 provides for effective coverage or scanning of the bowl opening. The top surfaces of the brackets 296, furthermore, provide bearing surfaces for the toilet seat. Additional tilting action of the arm 290 and hence the heads 68 and 70, may also be obtained by moving the handle 302 in a radial direction with respect to the bowl opening, so that the block 292 rotates about the shaft 294.

Figure 30:
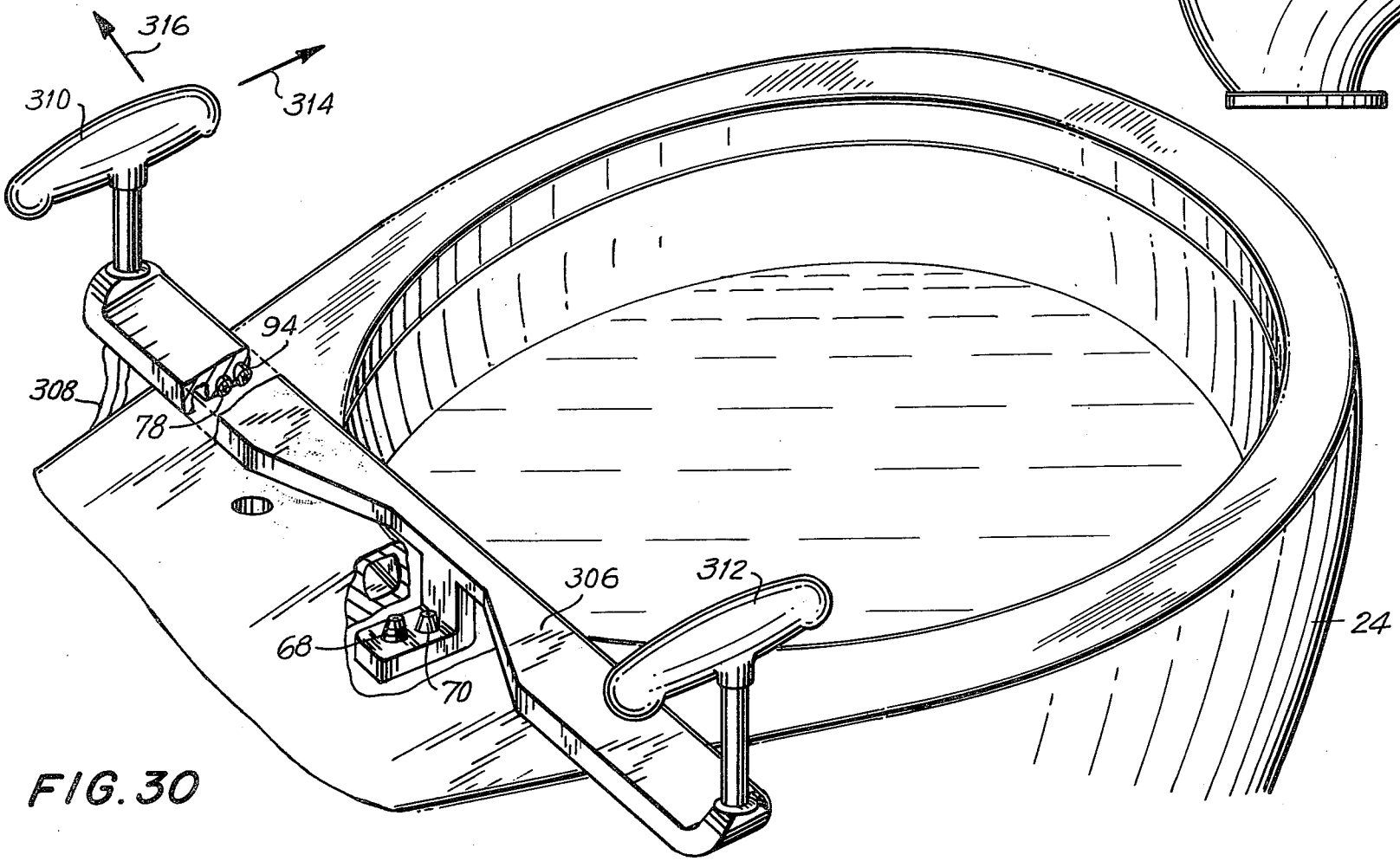
FIG. 30 is a perspective view of a further embodiment of the present invention.

In a still further embodiment of the present invention, as shown in FIG. 30, the heads 68 and 70 are carried by an arm 306 which is slidable directly on the upper rim surface of the bowl 24. The arm 306 may also be of molded plastic material, for example, and carry directly the water and air supply conduits 78 and 94 to the respective heads 68 and 70. To allow for free movement of the arm 306, a flexible supply line 308 is coupled to the arm 306 and supplies the conduits 78 and 94 with water and air.

In operation of the arrangement of FIG. 30, the user grips both handle 310 and 312 to move the heads 68 and 70 from the stowed position, shown in the drawing, to a substantially more central position in the bowl opening. Such motion of the heads is achieved by sliding the arms 306 on the top surface of the bowl rim, by moving the handles 310, 312 in the corresponding direction of arrow 314. To obtain positioning of the head in a direction which is transverse to the direction of arrow 314, the handles 310, 312 may be moved by the user in the direction of the arrow 316, for example. By moving the handles in these directions of the arrows 314 and 316, therefore, effective coverage or scanning of the bowl opening is achieved.

Figure 31:
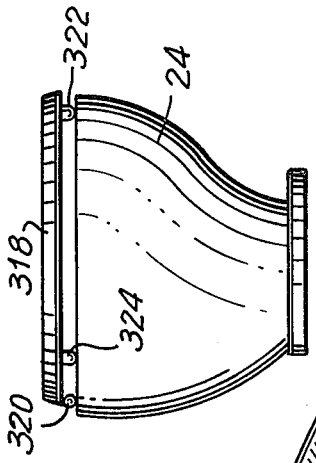
FIG. 31 is a side view of the toilet bowl in FIG. 30 with the toilet seat in place thereon.

To facilitate free movement of the arm 306 over the opening of the bowl, the toilet seat 318 is supported on the rim of the bowl as shown in FIG. 31. In accordance with this arrangement, the toilet seat 318 is connected to the top surface of the bowl by means of a hinge 320 at the rear of the bowl. The toilet seat 318, furthermore, is held spaced from the top rim surface of the bowl by means of bumpers 322, 324 at the front and rear of the bowl. No such bumpers are provided along the sides of the bowl, and by thus confining the bumpers to locations at the front and rear of the bowl, the arm 306 may slide freely on the bowl rim from the rear side to the front side thereof. At the same time, two bumpers may be provided at the front and rear of the seat 318 to provide for adequate support of the seat without interferring with the free movement of the arm 306.

It is an essential feature of the present invention that the douche attachment shown in FIG. 18 may be used in conjunction with any one of the embodiments described above. Furthermore, the parts of the embodiments described may be fabricated from dielectric non-porous plastic material which may be easily cleaned with caustic agents.

It is also an essential feature of the present invention that the embodiments described above may be used by persons who are invalids, as well as those persons who enjoy satisfactory health and prefer the bidet and hygienic cleansing features of the present invention to the conventional methods.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. A cleansing method comprising the steps of: moving a spray of cleaning fluid over a predetermined area and moving thereafter a stream of air over sand area to dry said area after having been wetted by said cleansing fluid; said spray of cleansing fluid and stream of air being moved over said area beneath the top rim opening of a receptacle; heating said cleansing fluid and said stream of air; applying pressure to said cleansing fluid and said stream of air, said pressure being applied selectively and separately for said fluid and said air; said steps of moving said spray of cleansing fluid and said stream of air comprising further moving said spray and said stream of air reciprocatingly along an axis traversing said area, the path of motion traced by said spray and said stream of air with respect to said axis having a predetermined amplitude and frequency; said spray and said stream of air being movable along a line relative to the rim of said receptacle.

2. A cleansing arrangement comprising, in combination, means for directing a spray of cleansing fluid onto a predetermined area; means for directing thereafter a stream of air onto said area to dry said area after having been wetted by said cleansing fluid; and motor driven means for moving both said means for directing the cleansing fluid and said means for directing said stream of air reciprocatingly along an axis traversing said area, the path of motion traced by said spray of fluid and said stream of air with respect to said axis having a predetermined amplitude and frequency; said area having a peripheral border, said spray and said stream of air being movable along a line relative to said peripheral border.

3. The arrangement as defined in claim 2 wherein said spray of cleansing fluid and said stream of air are moved over said area beneath the top rim opening of a receptacle, the rim forming said peripheral border; means for heating said cleansing fluid and said stream of air; means for applying pressure to said cleansing fluid and said stream of air; and means for adjusting selectively and separately the pressure of said fluid and said stream of air.

4. A cleansing arrangement comprising, in combination, means for moving a spray of cleansing fluid over a predetermined area; means for moving thereafter a stream of air over said area to dry said area after having been wetted by said cleansing fluid; bracket means for attaching to the rim of a receptacle; lever means pivoted on said bracket means and having means for directing said spray of cleansing fluid and said stream of air; said bracket means comprising two clamping members attachable to the rim of said receptacle; and pivoting means of one of said clamping members for pivotally supporting said lever means; and a slotted plate member on said one of said clamping members and having a slot through which said lever means projects for further supporting said lever means.

5. The arrangement as defined in claim 4 wherein said lever means has a slot movable with respect to said pivoting means on said one clamping member, said lever means passing over the top rim surface of said receptacle.

6. The arrangement as defined in claim 5 wherein said lever means has at one end a downward directed portion extending into the interior of said receptacle below the top rim surface thereof and holding said means for directing said spray of cleansing fluid and stream of air.

7. The arrangement as defined in claim 6 including means at the other end of said lever means for manually moving said lever means so that said spray of cleansing fluid and stream of air are moved over said area.

8. The arrangement as defined in claim 7 wherein said clamping members have a substantially U-shaped portion for passing over said top rim surface of said receptacle.

9. The arrangement as defined in claim 6 including flexible tubing means connected to said downward directed portion of said lever means for conducting said cleansing fluid and said stream of air to said directing means.

10. The arrangement as defined in claim 9 wherein said flexible tubing means comprises plastic tubing.

11. A cleansing arrangement comprising, in combination, means for directing a stream of fluid from a location within the opening of a receptacle for cleansing a person's posterior and parts in proximity thereof, said stream being directed substantially upwards from the interior of said receptacle; a movable supporting arm for supporting said means for directing said stream of fluid; lever means attached to one end of said supporting arm means; a member passing transversely over the rim of said receptacle and pivotally supporting said lever means, said member having a slot; an auxiliary membr passing through said slot and pivotally connected to the other end of said lever means; bracket means attachable to the rim of said receptacle and supporting pivotally said first-mentioned member; and handle means connected pivotally to said first-mentioned member and to said auxiliary member for moving said supporting arm means within the opening of said receptacle.

12. The arrangement as defined in claim 11 including douche means connectable to said means for directing said stream of fluid.

13. The arrangement as defined in claim 11 including conduit means for transporting said fluid to said means directing said stream of fluid from the interior of said receptacle, said conduit means being a molded member having at least one internal duct.

14. A cleansing arrangement comprising, in combination, means for directing a stream of fluid from a location within the opening of a receptacle for cleansing a person's poterior and parts in proximity thereof, said stream being directed substantially upwards from the interior of said receptacle; movable supporting arm means for supporting said means directing said stream of fluid; ball joint means connected to one end of said supporting arm means; bracket means attachable to the rim of said receptacle and retaining said ball joint means; and a member passing over the rim of said receptacle and pivotally connected to said ball joint means for moving said supporting arm means within the opening of said receptacle.

15. A cleansing arrangement comprising, in combination, means for directing a stream of fluid from a location within the opening of a receptacle for cleansing a person's posterior and parts in proximity thereof, said stream being directed substantially upwards from the interior of said receptacle; supporting arms means for supporting said means for directing said stream of fluid; bracket means attachable to the rim of said receptacle and pivotally holding said supporting arm means; ball joint means carried by said bracket means; movable handle means connected to said ball joint means, said bracket means having a slot; and at least one connecting rod means passing through said slot and connecting said supporting arm means to said handle means, movement of said handle means moving said supporting arm means within the opening of said receptacle.

16. A cleansing arrangement comprising, in combination, means for directing a stream of fluid from a location within the opening of a receptacle for cleansing a person's posterior and parts in proximity thereof, said stream being directed substantially upwards from the interior of said receptacle; supporting arm means for supporting said means for directing said stream of fluid, said arm means passing over the rim of said receptacle from the interior of said receptacle to the exterior thereof; ball joint means connected to the portion of said arm means on the exterior of said receptacle; slide means holding said ball joint means, said ball joint means being slidable substantially along the rim of said receptacle on said slide means; bracket means attachable to the rim of said receptacle and supporting said slide means; and handle means connected to said supporting arm means for moving said arm means within the interior of said receptacle.

17. A cleansing arrangement comprising, in combination, means for directing a stream of fluid from a location within the opening of a receptacle for cleansing a person's posterior and parts in proximity thereof, said stream being directed substantially upwards from the interior of said receptacle; supporting arm means for supporting said means for directing said stream of fluid, said supporting arm means extending over the rim of said receptacle and being attached to and slidable on the surface of said rim; and handle means connected to said supporting arm means for sliding said arm means on the rim of said receptacle to move said means for directing said stream of fluid within the opening of said receptacle.

* * * * *